US012006130B2

(12) United States Patent
Poppe et al.

(10) Patent No.: US 12,006,130 B2
(45) Date of Patent: Jun. 11, 2024

(54) STEM OF A VALVE

(71) Applicant: Altachem NV, Harelbeke (BE)

(72) Inventors: Jean-Marie Poppe, Heule (BE); Wouter Halfmaerten, Bruges (BE)

(73) Assignee: Altachem NV, Harelbeke (BE)

( * ) Notice: Subject to any disclaimer, the term of this patent is extended or adjusted under 35 U.S.C. 154(b) by 15 days.

(21) Appl. No.: 17/919,024

(22) PCT Filed: May 10, 2021

(86) PCT No.: PCT/EP2021/062375

§ 371 (c)(1),
(2) Date: Oct. 14, 2022

(87) PCT Pub. No.: WO2021/228789

PCT Pub. Date: Nov. 18, 2021

(65) Prior Publication Data

US 2023/0242331 A1 Aug. 3, 2023

(30) Foreign Application Priority Data

May 15, 2020 (BE) ..... 2020/5344

(51) Int. Cl.
*B65D 83/48* (2006.01)

(52) U.S. Cl.
CPC ..... *B65D 83/48* (2013.01)

(58) Field of Classification Search
CPC ..... B65D 83/46; B65D 83/48; B65D 83/14–759; F16K 31/58
See application file for complete search history.

(56) References Cited

U.S. PATENT DOCUMENTS 3,690,515 A * 9/1972 Ewald ..... B65D 83/682 222/402.18
4,008,834 A * 2/1977 Towns ..... B65D 83/46 222/513
4,322,037 A * 3/1982 Heeb ..... B05B 1/3436 239/573

(Continued)

FOREIGN PATENT DOCUMENTS

BE 1021068 B1 3/2015
EP 2 354 037 A1 8/2011

(Continued)

OTHER PUBLICATIONS

International Search Report in PCT/EP2021/062375, mailed Jul. 9, 2021.

(Continued)

*Primary Examiner* — Donnell A Long
*Assistant Examiner* — Randall A Gruby
(74) *Attorney, Agent, or Firm* — Collard & Roe, P.C.

(57) ABSTRACT

A stem of a valve for a container for dispensing pressurized fluid, has an inner channel inside a cylindrical housing connecting the at least one lateral inlet opening at its lower end and an outlet opening at its upper end. The inner channel has a conical shape at its lower end and the diameter of the cylindrical housing is increased towards the lower end of the stem and in particular in the section which corresponds to the section with lateral inlet openings. Both adaptations reinforce the stem and make it more resilient against bending and tensile forces.

4 Claims, 3 Drawing Sheets

SECTION A-A

(56) References Cited

U.S. PATENT DOCUMENTS

| | | | | |
|---|---|---|---|---|
| 4,471,893 | A * | 9/1984 | Knickerbocker | B65D 83/46 222/402.24 |
| 4,804,116 | A * | 2/1989 | Ball | B65D 83/46 222/399 |
| 4,824,075 | A * | 4/1989 | Holzboog | B65D 83/46 251/354 |
| 5,785,301 | A * | 7/1998 | Scheindel | B65D 83/46 251/354 |
| 6,056,163 | A * | 5/2000 | Lai | B65D 83/48 222/321.2 |
| 7,984,834 | B2 * | 7/2011 | McBroom | B65D 83/44 222/402.1 |
| 8,418,996 | B2 * | 4/2013 | Rideg | B05B 11/1077 222/402.1 |
| 8,905,273 | B2 * | 12/2014 | de Schrijver | B65D 83/28 222/402.1 |
| 9,399,544 | B2 * | 7/2016 | Dhaenens | B65D 83/46 |
| 10,266,334 | B2 * | 4/2019 | Baker | B65D 83/46 |
| 11,358,783 | B2 * | 6/2022 | Baker | B65D 83/48 |
| 2001/0027982 | A1 * | 10/2001 | Lilienthal | B65D 83/62 222/387 |
| 2007/0215650 | A1 * | 9/2007 | De Schrijver | B65D 83/46 222/402.21 |
| 2009/0078902 | A1 * | 3/2009 | Flynn | B65D 83/46 251/149.8 |
| 2023/0182993 | A1 * | 6/2023 | Poppe | B65D 83/46 222/556 |

FOREIGN PATENT DOCUMENTS

| | | | |
|---|---|---|---|
| EP | 2 481 688 | A1 | 8/2012 |
| WO | 82/02533 | A1 | 8/1982 |
| WO | 2009/004097 | A1 | 1/2009 |

OTHER PUBLICATIONS

Written Opinion of the International Searching Authority in PCT/EP2021/062375, mailed Jul. 9, 2021.

International Preliminary Report on Patentability in PCT/EP2021/062375, mailed May 10, 2022.

* cited by examiner

STEM OF A VALVE

CROSS REFERENCE TO RELATED APPLICATIONS

This application is the National Stage of PCT/EP2021/062375 filed on May 10, 2021, which claims priority under 35 U.S.C. § 119 of Belgium Application No. BE2020/5344 filed on May 15, 2020, the disclosure of which is incorporated by reference. The international application under PCT article 21(2) was published in English.

BACKGROUND OF THE INVENTION

1. Field of the Invention

The invention concerns a stem of a valve for a container for dispensing a pressurized fluid, said stem having an inner channel inside a cylindrical housing connecting the at least one lateral inlet opening at its lower end and an outlet opening at its upper end.

2 Description of the Related Art

Hollow stems are usually used in valves for containers to dispense a pressurized fluid. The stem is providing in a passage for a pressurized fluid which is part of a valve and mounted onto a container. The stem is displaceable between a closed position and an open position. In the open position, the pressurized fluid inside the container can be released through the lateral inlet opening at the lower end of the stem passing through the inner channel of the stem and being released through the outlet ending of the stem. The valve can provide spring means for pushing the stem in its closed position, in which the container is sealed and the passageway through the stem is blocked. The stem of the valve is exposed to bending and tensile force which can lead to material failure of the stem.

It is known in the prior art to reinforce stems with fibers, e.g. glass fibers, basalt fibers or wollastonite fibers. However, the reinforcing fibers are expensive and increase significantly the production costs of the stem. Furthermore, due to the presence of fibers the production tools and molds wear out faster than without reinforcement fibers which also leads to increased production costs. EP 2 354 037 A1, EP 2 481 688 A1 and BE 1 021 068 B1 describe stems for a valve for dispensing pressurized fluids with a conical shape at its lower end.

SUMMARY OF THE INVENTION

It is therefore an object of the present invention to provide an optimized stem.

This object is achieved according to the invention by a stem in which the inner channel has a parabolic shape at its lower end.

The main advantages of these measures are the following. The parabolic shape of the inner channel of the hollow stem confers a higher rigidity to the stem. The bending and mainly the tensile/compression forces which act on the stem while the using the valve or due to unintentional force on the exposed stem are better distributed and can be introduced in the cylindrical housing of the stem by the parabolic shape of the lower end of the inner channel. As an example, for opening the valve the stem must be pushed in direction of the container and thus against the effect of pressure in the container in order to displace the stem from its closed position into its open position. The pressurized fluid exerts a force on the bottom end of the stem which is then introduced into the cylindrical housing of the stem. The higher rigidity of the stem due to the parabolic shape of the inner channel allows to reduce the amount of material to produce the stem which also reduces the production costs of the stem.

As an advantage, the parabolic shape smoothens out hard edges which are usually found in hollow stems at their lower end. These edges form a weak point, stress concentrations of the stem and can therefore lead to material failure when the stem is exposed to bending and tensile force.

As an additional advantage, the parabolic shape of the lower end of the inner channel can optimize the fiber direction of filled materials. In this way forces acting on the stem can be better distributed and introduced in the cylindrical housing of the stem. Especially for dispensing high pressure fluids the optimized fiber directions improve the rigidity of the stem.

According to a further preferred embodiment, the cylindrical housing broadens toward the lower end of the stem.

The diameter of the cylindrical housing and its thickness is increased towards the lower end of the stem. As a result, the stem is mainly more resilient to bending forces acting on the stem but also improves the tensile/compression resistance of the stem. The potential mechanical weak point of the connection between the flange and the cylindrical housing is reinforced. The stability of the lower section of the stem with the lateral inlet openings is improved by the increased diameter of the cylindrical housing surrounding the lateral inlet openings.

Especially the combination of the parabolic shape of the inner channel and the increased outer diameter of the cylindrical housing of the lower end of the stem increases the stability of the stem. The parabolic shape of the inner channel makes the stem mainly more resilient against tensile/compression forces while the increased outer diameter of the cylindrical housing contributes mainly to the resilience against bending forces. Both structural improvements reinforce the potential weak point of the stem at its lower end.

According to a preferred embodiment of the invention the stem is provided on its lower end with a flange.

The flange can abut in the closed position of the stem against the housing of the valve thereby closing the passageway through the stem. This is a very reliable solution for closing the passageway. The pressurized fluid exerts force on the flange when the stem is pushed into its open position. As an advantage, the parabolic shape of the inner channel reinforces the stem.

Furthermore, according to the present invention, a top sealing part is provided around the outlet opening of the stem.

This top sealing part is the interface between the stem and an actuator or adapter which may be placed on the valve. The top sealing part can also provide means for limiting the opening distance of the valve. These means make sure that the valve is not opened beyond a maximum opening distance. The means can be a contact surface which abuts against the housing of the valve.

The valve according to the present invention can be used for dispensing foam, preferably one or two component polyurethane foam.

BRIEF DESCRIPTION OF THE DRAWINGS

In the following, the invention is discussed more in detail with reference to preferred embodiments shown in the drawings in which.

DETAILED DESCRIPTION OF THE PREFERRED EMBODIMENTS

Figure 1:
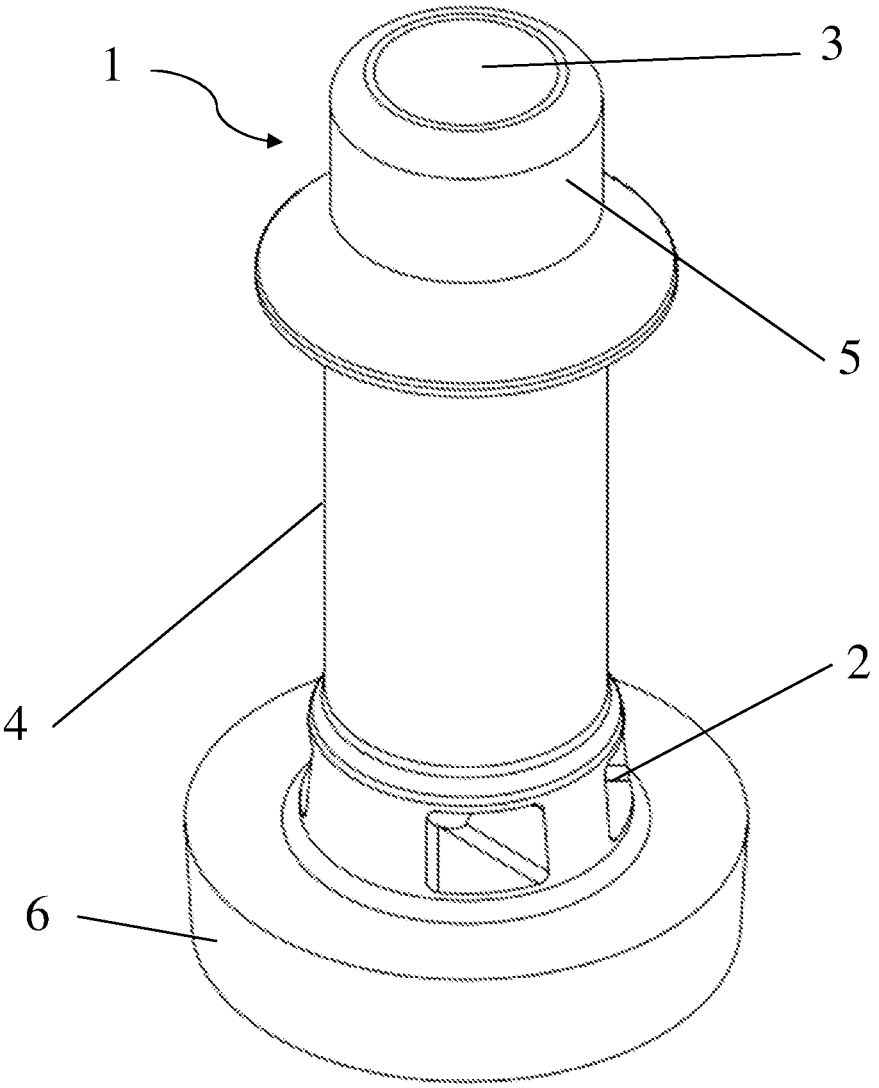
FIG. 1 shows a perspective representation of stem according to the present invention.
Figure 2:
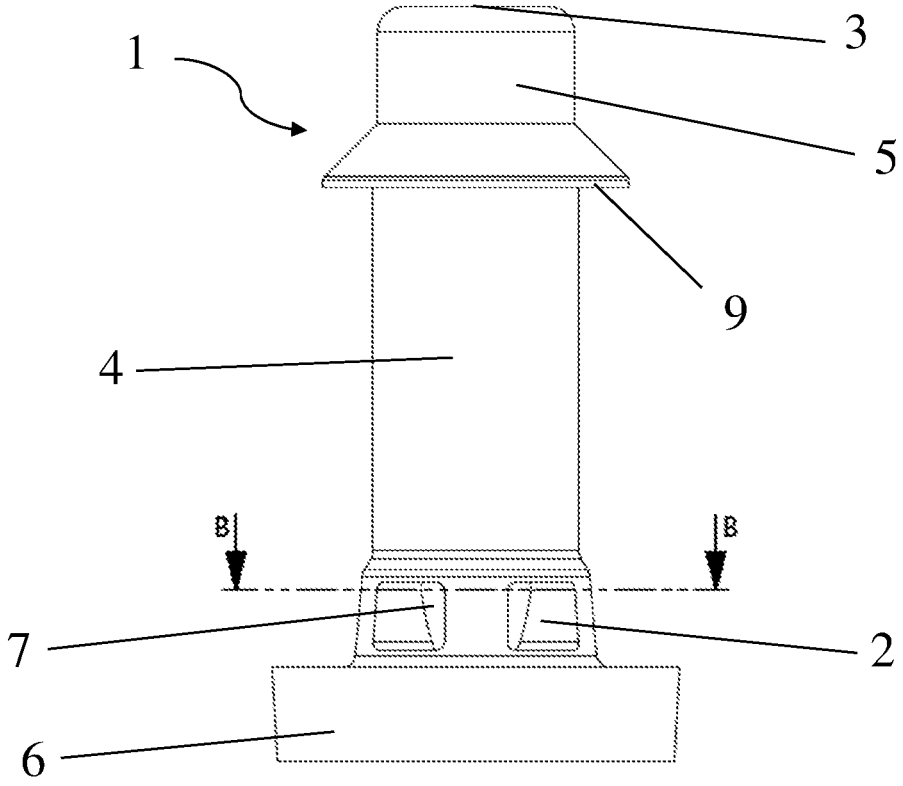
FIG. 2 shows a side view of the same stem.
Figure 3:
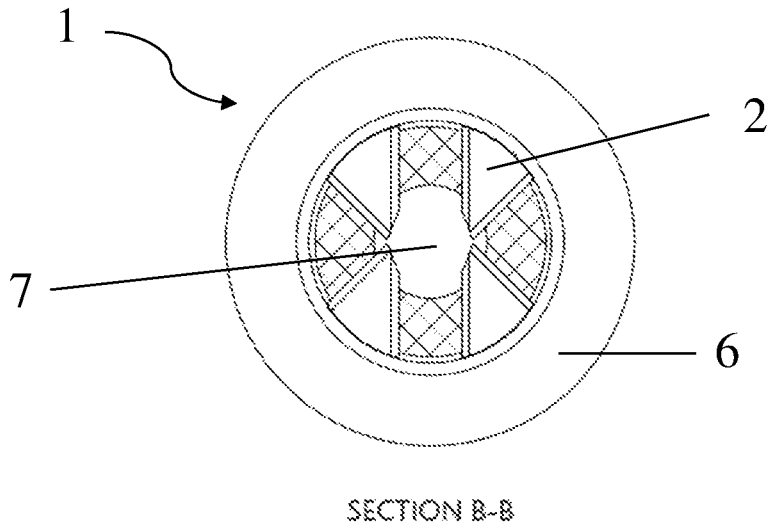
FIG. 3 shows a cut representation of the same stem.
Figure 4:
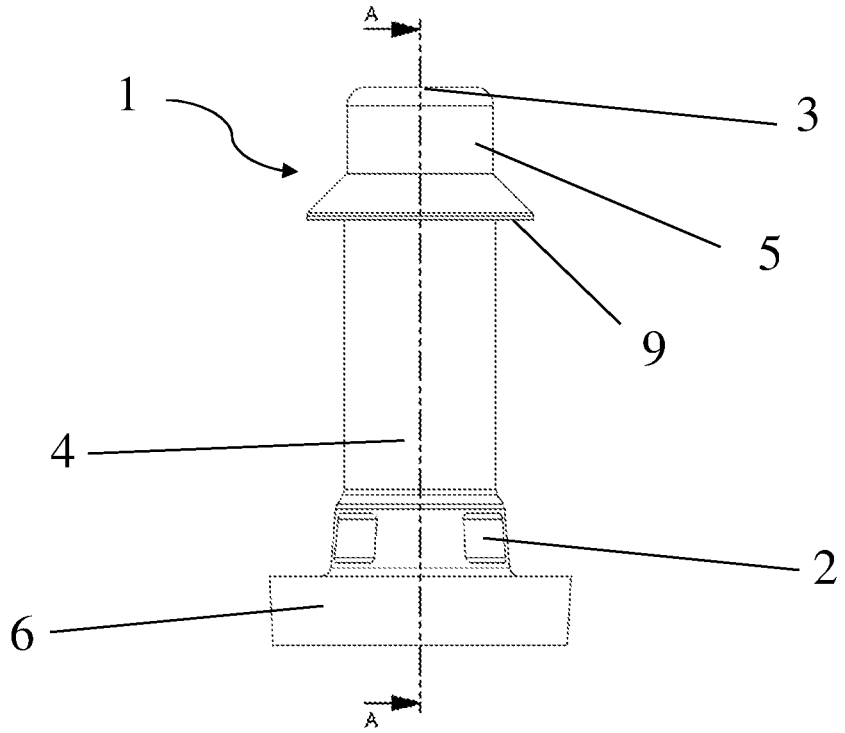
FIG. 4 shows another side view of the same stem.
Figure 5:
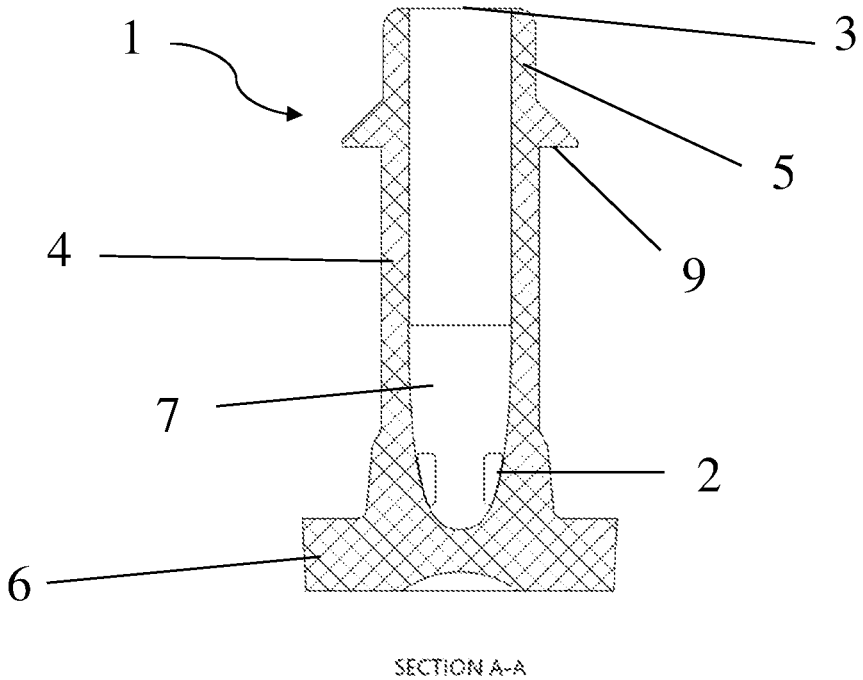
FIG. 5 shows another cut representation of the same stem.

The FIGS. 1 to 5 show a stem 1 for a valve of a container for dispensing pressurized fluid, preferably foam, in particular one component or two component polyurethane foam.

The stem 1 comprises of a cylindrical housing 4 with an inner channel 7 as a passageway of the pressurized fluid. The inner channel 7 connects the lateral inlet openings 2 at the lower end of the stem 1 with an outlet opening 3 at the upper end of the stem 1. To reinforce the stem 1, the inner channel 4 has a parabolic shape at its lower end. The parabolic shape of the inner channel 4 of the hollow stem 1 confers a higher rigidity to the stem 1 and increases the resilience of the stem 1 tensile/compression forces and also but to a lesser extent the bending force.

The diameter of the cylindrical housing 4 is increased towards the lower end of the stem 1 and in particular in the section which corresponds to the section with the lateral inlet openings 2. As a result, the stem 1 is more resilient to bending forces acting on the stem 1. The stability of the lower section of the stem 1 with the lateral inlet openings 2 is improved by the increased diameter of the cylindrical housing 4.

The flange 6 abuts in the closed position of the stem 1 against the housing of the valve thereby closing the passageway through the inner channel 7 of the stem 1.

The stem 1 provides a top sealing part 5 around the outlet opening 3. This top sealing part 5 is the interface between the stem 1 and an actuator or adapter which may be placed on the valve. The top sealing part 5 has a contact surface 9 for limiting the opening distance of the valve. The contact surface 9 abuts the housing of the valve and inhibits an opening of the valve beyond a maximum opening distance.

The invention claimed is:

1. A stem of a valve for a container for dispensing pressurized fluid, said stem comprising:

a lower stem end having at least one lateral inlet opening;

an upper stem end having an outlet opening; and an inner channel inside a cylindrical housing connecting the at least one lateral inlet opening and the outlet opening;

wherein the inner channel has a parabolic shape at a lower inner channel end of the inner channel.

2. The stem according to claim 1, wherein the cylindrical housing exteriorly broadens toward the lower stem end.

3. The stem according to claim 1, wherein the lower stem end has a flange.

4. The stem according to claim 1, wherein a top sealing part is provided around the outlet opening.

* * * * *